US011498127B2

(12) United States Patent
Maruyama et al.

(10) Patent No.: US 11,498,127 B2
(45) Date of Patent: Nov. 15, 2022

(54) DEVICE AND METHOD FOR MANUFACTURING MULTILAYER MOLDED ARTICLE

(71) Applicant: DIAMET CORPORATION, Niigata (JP)

(72) Inventors: Tsuneo Maruyama, Niigata (JP); Shinichi Takezoe, Niigata (JP); Hideo Sakai, Niigata (JP)

(73) Assignee: DIAMET CORPORATION, Niigata (JP)

( * ) Notice: Subject to any disclaimer, the term of this patent is extended or adjusted under 35 U.S.C. 154(b) by 846 days.

(21) Appl. No.: 16/317,430

(22) PCT Filed: Aug. 10, 2017

(86) PCT No.: PCT/JP2017/029027
§ 371 (c)(1),
(2) Date: Jan. 11, 2019

(87) PCT Pub. No.: WO2018/034218
PCT Pub. Date: Feb. 22, 2018

(65) Prior Publication Data

US 2019/0232374 A1 Aug. 1, 2019

(30) Foreign Application Priority Data

Aug. 16, 2016 (JP) ..... JP2016-159569

(51) Int. Cl.
*B22F 7/02* (2006.01)
*B30B 11/02* (2006.01)
(Continued)

(52) U.S. Cl.
CPC ..... *B22F 7/02* (2013.01); *B22F 7/06* (2013.01); *B30B 11/00* (2013.01); *B30B 11/02* (2013.01); *B30B 15/306* (2013.01)

(58) Field of Classification Search
CPC ..... B22F 7/02
See application file for complete search history.

(56) References Cited

U.S. PATENT DOCUMENTS 2,888,715 A * 6/1959 Frank ..... B30B 11/027 419/66
5,698,149 A 12/1997 Hinzmann et al.
2016/0193659 A1* 7/2016 Kim ..... C22C 33/0264 419/66

FOREIGN PATENT DOCUMENTS

CA 2445514 A1 11/2002
DE 69325924 T2 2/2000
(Continued)

OTHER PUBLICATIONS

English machine translation of JP S58-141895A of Hirai retrieved on Aug. 20, 2021 (Year: 1983).*
(Continued)

*Primary Examiner* — Jophy S. Koshy
*Assistant Examiner* — Joshua S Carpenter
(74) *Attorney, Agent, or Firm* — Leason Ellis LLP

(57) ABSTRACT

A die having a cavity and a lower punch fitted into the cavity. The cavity is divided and the parts slide along a division plane passing through the cavity parallel to the fitting direction of the die and the lower punch. The divided cavity parts are placed in a state of alignment along the division plane. The divided cavity parts are each filled with raw material powder. The die and the lower punch are then slid along the division plane, whereby the divided cavity parts are combined as the original cavity. The raw material powder in the cavity in a combined state is compressed by an upper punch and the lower punch.

7 Claims, 12 Drawing Sheets

(51) Int. Cl.

| | |
|---|---|
| ***B30B 15/30*** | (2006.01) |
| ***B22F 7/06*** | (2006.01) |
| ***B30B 11/00*** | (2006.01) |

(56) References Cited

FOREIGN PATENT DOCUMENTS

| | | | | | |
|---|---|---|---|---|---|
| EP | 0680405 | B1 | | 11/1995 | |
| JP | 58-141895 | A | | 8/1983 | |
| JP | 58141895 | A | * | 8/1983 | ..... B30B 15/306 |
| JP | 06-210495 | A | | 8/1994 | |
| JP | 08-104905 | A | | 4/1996 | |
| JP | 08-134509 | A | | 5/1996 | |
| JP | 08-318010 | H | | 12/1996 | |
| JP | 2005-66685 | A | | 3/2005 | |

OTHER PUBLICATIONS

Chinese Office Action dated Sep. 9, 2020 for the corresponding Chinese Patent Application No. 201780044317.7.
Indian Examiner Report dated Jun. 14, 2021 for the corresponding Indian Patent Application No. 201917002193.
Extended European Search Report dated Feb. 4, 2020 for the corresponding European Patent Application No. 17841441.3.
International Search Report dated Sep. 5, 2017 for the corresponding PCT Patent Application No. PCT/JP2017/029027.

* cited by examiner

DEVICE AND METHOD FOR MANUFACTURING MULTILAYER MOLDED ARTICLE

CROSS-REFERENCE TO RELATED PATENT APPLICATIONS

This application is a U.S. National Phase Application under 35 U.S.C. § 371 of International Patent Application No. PCT/JP2017/029027 filed on Aug. 10, 2017 and claims the benefit of Japanese Patent Application No. 2016-159569, filed Aug. 16, 2016, all of which are incorporated herein by reference in their entireties. The International Application was published in Japanese on Feb. 22, 2018 as International Publication No. WO/2018/034218 under PCT Article 21(2).

BACKGROUND OF THE INVENTION

Technical Field

The present invention relates to a manufacturing device and a manufacturing method for manufacturing a multilayer molded article including layers made from different kinds of material powder in powder molding.

Background Art

In powder molding, when a multilayer molded article having layers made from different kinds of powder is formed, for example, a bearing in which an inner peripheral part and an outer peripheral part are made from metals of different kinds of material is made by arranging a dividing board between the inner peripheral part and the outer peripheral part, filling the different kinds of powder into the inside and outside thereof, and removing the dividing board, then press molding.

For example, Japanese Unexamined Publication No. H08-318010discloses a device for manufacturing a golf club head which is provided with a die forming a peripheral surface along a club face of a compressed powder body to be a golf club head, lower punches and a division punch inserted upward from below into the die for forming a back side of the compressed powder body, an upper punch inserted downward from above into the die for forming a face side of the compressed powder body, and a feeder which can feed powder of different kinds of raw material individually into the die. The lower punches and the division punch are individually movable up and down with respect to the die; and the division punch is arranged between the lower punches and divides the inside of the die. It is described that in a state in which the division punch divides the die into a center part and a peripheral part and the lower punches close up a space of the center part, the raw material powder is filled in a space of the peripheral part. Next, the lower punches in the center part are got down so that the other raw material powder is filled into the space thereof: after that, the division punch is got down, and then the raw material powder is compressed and formed.

Problems to be Solved by the Invention

In the device described in Japanese Unexamined Publication No. H08-318010, it is better that the division punch dividing the space of the die is as thin as possible; however, a certain degree of thickness is necessary for strength of the die. Therefore, a thin space with a range of the thickness of the division punch is formed if the division punch gets down after filling the raw material powder into the space in a divided state by the division punch: as a result, a part of the raw material powder filled in the center part or the peripheral part is broken into the space generated by the division punch getting down, so that it is difficult to accurately form a boundary between the center part and the peripheral part.

Moreover, there is a problem in which the raw material powder to be filled into the center part is filled also on the raw material powder in the peripheral part because when the raw material powder is filled into the space of the center part after filling the raw material powder into the space of the peripheral part, a shoe box moves above the raw material powder previously filled in the peripheral part.

The present invention is achieved in consideration of the above circumstances, and has an object to provide a manufacturing device and a manufacturing method which accurately forms the boundary between the layers and which can prevent a mixture of the different kinds of the raw material powder.

SUMMARY INVENTION

Solution to Problem

A manufacturing device of the present invention includes: a die forming a cavity; a lower punch which can be inserted into the cavity from beneath and an upper punch which can be inserted into the cavity from above; and a shoe box which can move on a surface of the die in order to fill raw material powder into the cavity. In the device, the die and the lower punch are provided to be segmented into a plurality of segmental dies and segmental lower punches by a division plane parallel to a direction of an insertion of the lower punch across the cavity, and slidable along the division plane; the cavity can be divided to a plurality of divided cavities, along with a slide of the segmental dies and the segmental lower punches, along the division plane; the shoe box can move along a direction crossing the division plane; and the raw material powder can be respectively filled in the divided cavities divided when the segmental dies and the segmental lower punches are slid along the division plane.

According to this manufacturing device, the die and the lower punch can slide along the division plane. Sliding these parts so as to divide the cavity into plural, the respective cavities which are divided (these are called divided cavities) are placed in a state of alignment along the division plane: accordingly, by moving the shoe box in a direction across the division plane, the other kind of raw material powder can be reliably filled into the respective divided cavities individually without mixing the other kinds of raw material powder. Moreover, the cavities are combined at the division plane, so that there is no gap between the divided cavities and the boundary can be formed accurately.

As a preferred embodiment of the manufacturing device of the present invention, it is preferable that in the shoe box, a plurality of powder supplying parts storing the raw material powder be arranged along the division plane.

Dividing the cavity, the divided cavities are placed in a state of alignment along the division plane. Accordingly, since the shoe box is like this, the raw material powder can be filled into the respective divided cavities by one movement of the shoe box.

As a preferred embodiment of the manufacturing device of the present invention, the division plane may be a flat surface, or may be a curved surface curving in a sliding direction.

In a manufacturing method of the present invention, segmenting a die for forming a cavity and a lower punch inserted into the cavity to a plurality of segmental dies and a plurality of segmental lower punches along a division plane across the cavity and parallel to an insertion direction and sliding them, so that a plurality of divided cavities which are divided along with the sliding of the segmental dies and the segmental lower punch are aligned along the division plane; and after filling raw material powder in the respective divided cavities, sliding the segmental dies and the segmental lower punches along the division plane so that they are combined to each other as the original die and lower punch, so as to combine the divided cavities to each other as the original cavity and to compress the raw material powder in the combined cavity between an upper punch and the lower punch.

Advantageous Effects of Invention

The present invention enables to accurately form boundaries between layers and prevent mixing of kinds of raw material powder in a case in which a multilayer molded article with different kinds of raw material powder is manufactured.

BRIEF DESCRIPTION OF THE DRAWINGS

FIG. 1A shows a top view of a die; and a lower column FIG. 1B shows a vertical sectional view thereof schematically.

FIG. 12A is a perspective view of a multilayer molded article; FIGS. 12B and 12C are schematic top views of the die as same as in FIGS. 1A and 2A; FIG. 12B shows a state of dividing the cavity; and FIG. 12C shows an initial state.

DESCRIPTION OF EMBODIMENTS

Below, embodiments of a manufacturing device and a manufacturing method according to the present invention will be explained.

Figure 11:
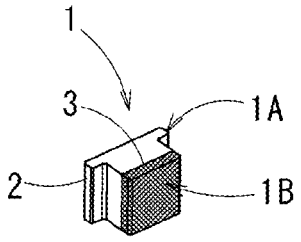
FIG. 11 is a perspective view showing a first embodiment of a multilayer molded article according to the present invention.

First, a multilayer molded article 1 made of layers formed by a manufacturing device of a first embodiment will be explained. The multilayer molded article 1 is, as shown in FIG. 11, formed to have a block shape with sectional surface shapes are the same along a vertical direction. In this multilayer molded article 1, a project part 2 is formed on a one-side part of the multilayer molded article 1: a vertically dividing plane 3 is provided so as to be parallel to a projection direction of the project part 2 in a vicinity of an other-side part: different kinds of raw material powder are used at left and right side parts (a side at the one-side part and a side at the other-side part) of the plane 3: and these are joined as one piece at the vertically dividing plane 3. The part having the project part 2 is called a one-side part side block 1A; and the other part is called an other-side part side block 1B.

Figure 7:
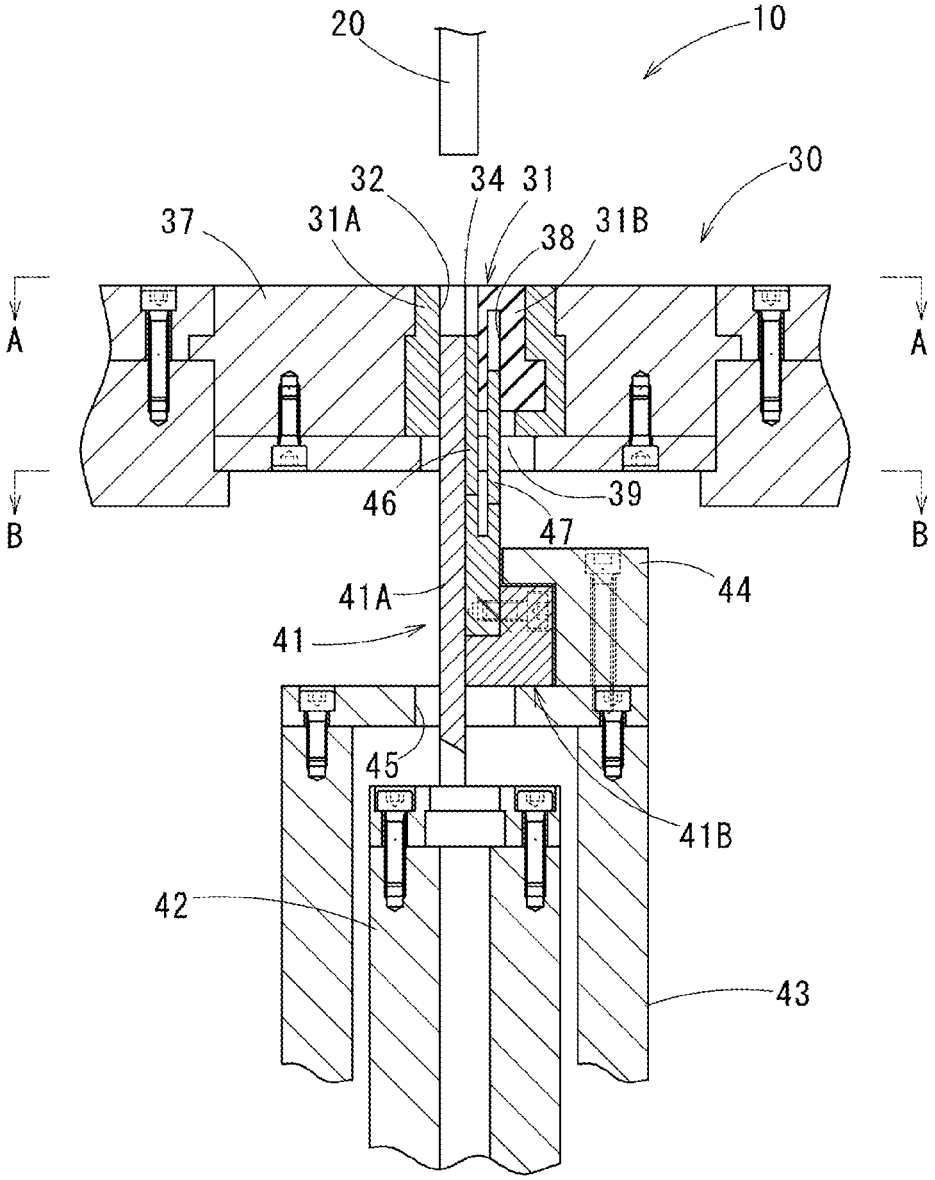
FIG. 7 is a vertical sectional view showing a first embodiment of a device for manufacturing a multilayer molded article according to the present invention.

A manufacturing device 10 is provided with an upper die (only an upper punch 20 is shown in the drawings), a lower die 30, and a shoe box 50 (refer to FIGS. 1 and 2) moving on an upper surface of the lower die 30 as shown in FIG. 7.

Figure 9A:
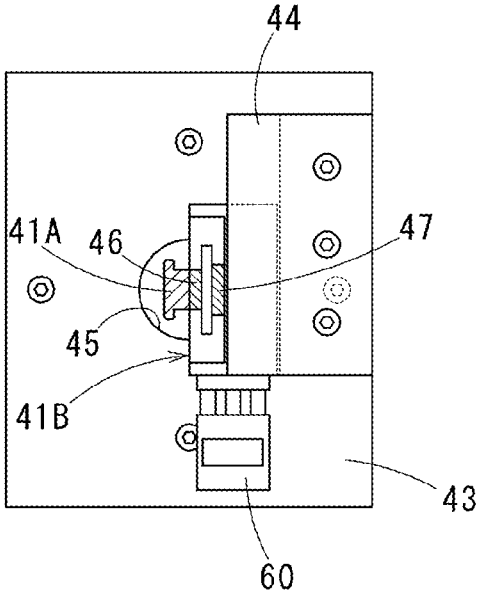
FIGS. 9A and 9B are arrow views taken along the line B-B at a part of a lower punch shown in FIG. 7, an initial state is shown in FIG. 9A and a state in which a cavity is divided is shown in FIG. 9B.
Figure 9B:
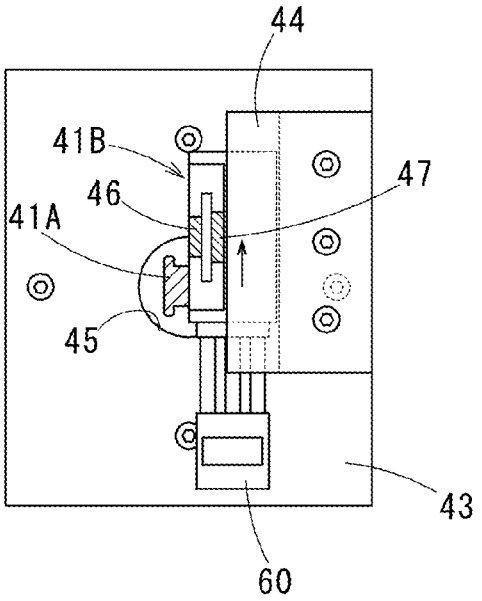
Figure 10:
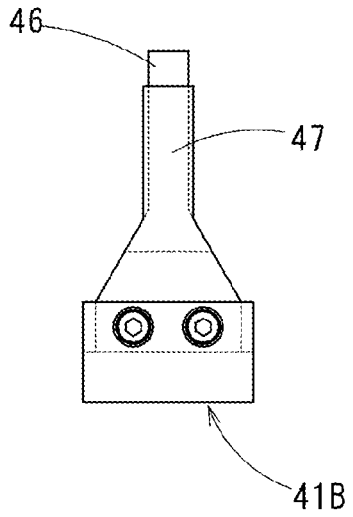
FIG. 10 is a right side view of the lower punch used in FIG. 7.

The lower die 30 is provided with a die 31 having a through hole along a vertical direction, a lower punch 41 fit-inserted into the through hole, and an actuator 60 (refer to FIGS. 9A and 9B) actuating a part of the die 31 and a part of the lower punch 41 as described later.

Figure 8A:
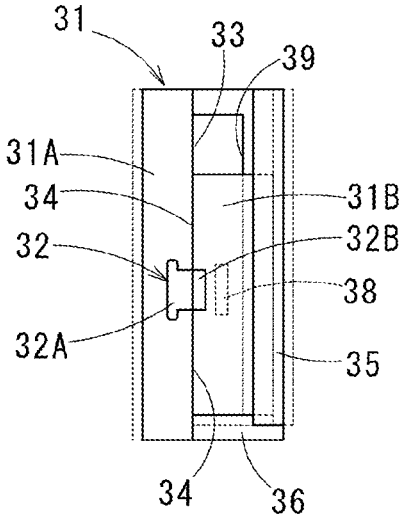
FIGS. 8A amd 8B are arrow views taken along the line A-A at a part of a die shown in FIG. 7, an initial state is shown in FIG. 8A and a state in which a cavity is divided is shown in FIG. 8B.
Figure 8B:
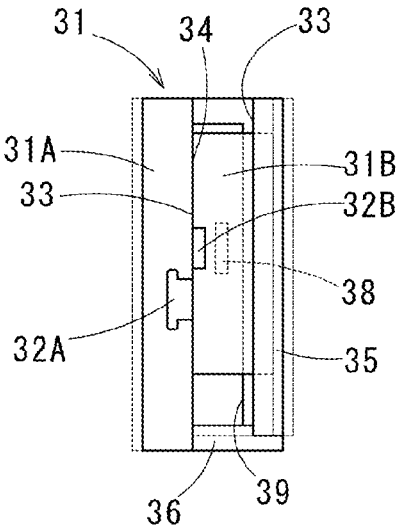

The die 31 forms a cavity 32 into which raw material powder is filled by fit-inserting an upper end part of the lower punch 41 into the through hole; and is separated, including the cavity 32, into a first segmental die 31A and a second segmental die 31B by one plane along the fit-insertion direction. In this case, as shown in FIGS. 8A and 8B, a groove 33 which is rectangle in a planar view is horizontally formed in the first segmental die 31A: the second segmental die 31B is put slidably in the groove 33. One side surface of the groove 33 is formed to be a plane surface along the vertical direction. One side surface of the groove 33 of the second segmental die 31B is also in contact with the one side surface of the groove 33: this one side surface is a division plane 34 between the first segmental die and the second segmental die. The cavity 32 is also divided to a first divided cavity 32A formed in the first segmental die 31A and a second divided cavity 32B formed in the second segmental die 31B with the division plane 34 therebetween. On the other, a side surface of a counter side to the division plane 34 in the groove 33 is formed to be crooked so as to form the groove 33 to be a dove tail like groove, and is a guide part 35 guiding a movement of the second segmental die 31B by fitting a lower end part thereof. On one end part of the groove 33 in the first segmental die 31A, a stopper 36 is provided to restrict an initial position of the second segmental die 31B so as to combine the respective cavities 32A and 32B into one cavity 32 when the second segmental die 31B is in contact with the stopper 36.

The die 31 is fixed to a die holder 37. The die holder 37 is held vertically movable by an actuator which is not illustrated.

The lower punch 41 is also segmented along the same plane surface as that of the die 31; and formed from a first segmental lower punch 41A which is fit-inserted to the first segmental die 31A and a second segmental lower punch 41B which is fit-inserted to the second segmental die 31B. The first segmental lower punch 41A is fixed to an upper end of a first fixing part 42 of the lower die 30. The first fixing part 42 is held on the lower die 30 in a state in which a position of the vertical direction is fixed.

The second segmental lower punch 41B is held on a second fixing part 43 of the lower die 30 movably in the horizontal direction along the division plane 34 with the first segmental lower punch 41A. On an upper surface of the second fixing part 43, a guide 44 guiding a movement of the second segmental lower punch 41B and an actuator 60 (refer to FIGS. 9A and 9B) actuating the second segmental lower punch 41B in the horizontal direction along the division surface 34 are provided. A hole 45 through which the first segmental lower punch 41A is passed is formed on the second fixing part 43. A hole 39 through which the lower punch 41 is passed is formed on the die 31.

The second segmental lower punch 41B has a rod part 47 formed integrally on an upper end part thereof and extending parallel to a punch part 46 of the second segmental lower punch 41B as shown in FIGS. 7, 9A and 9B, and 10. An upper end part of the rod part 47 is fit-inserted into a recess part 38 formed on the second segmental die 31B. The recess part 38 restricts the movement along the horizontal direction orthogonal to the fit-insertion direction of the second segmental lower punch 41B though, but allows the movement along the fit-insertion direction of the second segmental lower punch 41B: it is possible to move an upper end surface of the punch part 46 of the second segmental lower punch 41B so as to agree an upper surface of the die 31 or slightly project upward. Accordingly, the second segmental lower punch 41B and the second segmental die 31B are moved integrally in the horizontal direction along the division plane 34 in a state in which the rod part 47 is fit-inserted to the recess part 38.

The shoe box 50 is formed to be a box shape in which a lower side is opened, and is fed the raw material powder from supplying pipes 51 and 52 connected to an upper part thereof. Inside is separated to two powder feeding part 50A and 50B by a partition wall 53 for supplying different kinds of raw material powder respectively. In this case, the shoe box 50 supplies the raw material powder to the cavity 32 while moving along a direction orthogonal to the division plane 34 in the die 31 and the lower punch 41 described above: the partition wall 53 is formed along the moving direction. Therefore, the two powder supplying parts 50A and 50B are arranged side by side along a direction orthogonal to the moving direction of the shoe box 50.

Next, a method for manufacturing the multilayer molded article 1 using the manufacturing device 10 configured as above will be explained.

The multilayer molded article 1 is manufactured into a final shape by: a raw material powder filling step filling the raw material powder in the cavity 32 of the lower die 30; a compressed powder body forming step forming a compressed powder body by compressing the filled raw material powder; a sintering step sintering the compressed powder body; a reforming step reforming an external form of the sintered product as necessary, and the like. The above-mentioned manufacturing device 10 is used for the raw material powder filling step and the compressed powder body forming step so as to form the compressed body in order from the initial position shown in FIG. 1A to FIG. 6C. FIGS. 1A, 2A, 3A, 4A, 5A*a* and 6A show a planer view and FIGS. 1B, 2B, 3B, 4B, 5B and 6B show a vertical sectional view.

In the following explanation, the compressed powder body is explained with the same reference symbols as that of the multilayer molded article in a case in which the compressed powder body is explained since the compressed powder body has substantially the same shape as that of the final multilayer molded article.

Below it will be explained in order of the steps.

—Raw Material Powder Filling Step—

Figure 1A:
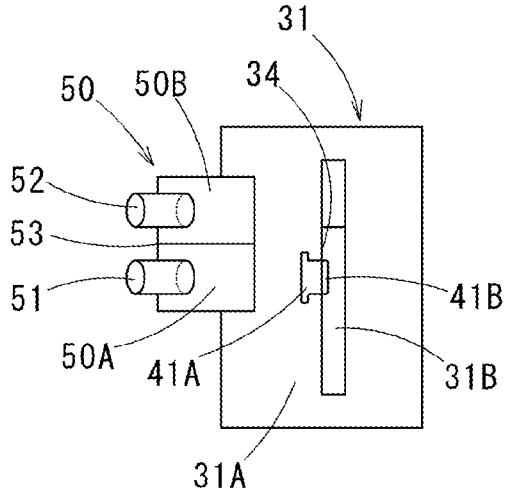
FIGS. 1A and 1B are a drawings showing an initial state before filling powder with respect to a first embodiment of a method for manufacturing a multilayer molded article according to the present invention: an upper column
Figure 1B:
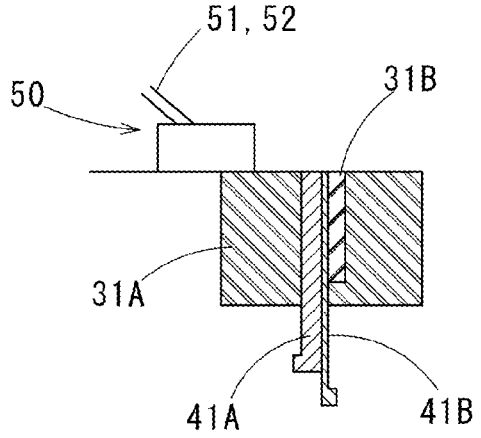
Figure 2A:
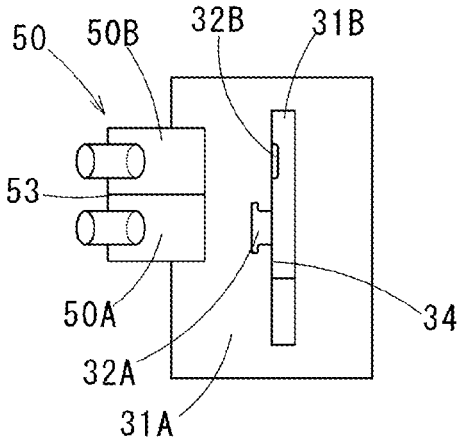
FIGS. 2A and 2B are drawings following the initial state shown in FIGS. 1A and 1B, schematically showing an upper surface of the die in FIG. 2A showing a state in which a cavity is formed and powder is filled in a shoe box, and a vertical sectional view thereof in FIG. 2B.
Figure 2B:
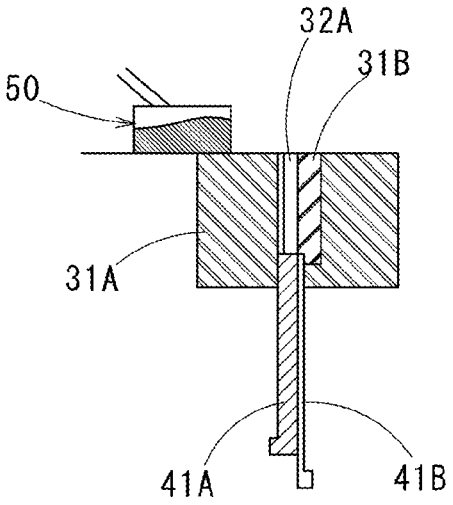

In an initial position shown in FIGS. 1A and 1B, the upper surface of the die 31 and the upper surface of the lower punch 41 are aligned on one plane. Accordingly, the cavity 32 is not formed yet. In this initial position, the die 31 and the lower punch 41 are in a state of being assembled at the division plane 34.

Moving up the die 31 from this initial position, the upper surface of the lower punch 41 is relatively moved down from the upper surface of the die 31, so that the cavity 32 is formed above; and the second segmental lower punch 41B is actuated by the actuator 60 so as to move along the division plane 34. Accordingly, it becomes a state shown in FIGS. 2A and 2B; the cavity 32 is separated to two of the first divided cavity 32A and the second divided cavity 32B and becomes a state of being aligned at separated positions along the division plane 34. The shoe box 50 stays on the upper surface of the die 31, and the raw material powder is supplied to the respective powder supplying parts 50A and 50B.

Figure 3A:
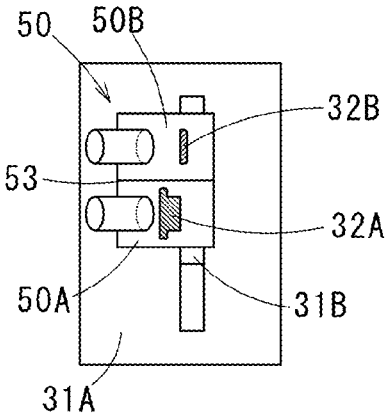
FIGS. 3A and 3B are drawings following a state shown in FIGS. 2A and 2B, schematically showing the upper surface of the die in FIG. 3A showing a state in which the powder is filled in the cavity, and a vertical sectional view thereof in FIG. 3B.
Figure 3B:
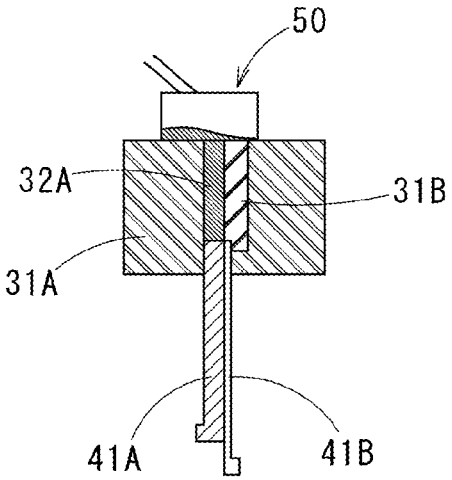

Then, as shown in FIGS. 3A and 3B, moving the shoe box 50 along the upper surface of the die 31 to an upper part of the cavity 32, the raw material powder is supplied to the divided cavities 32A and 32B respectively from the inside of the powder supplying parts 50A and 50B. The shoe box 50 has the partition wall 53 formed along a direction orthogonal to the division plane 34 between the two powder supplying parts 50A and 50B: arranging the partition wall 53 between both the divided cavities 32A and 32B, the raw material powder is reliably supplied to the respective divided cavities 32A and 32B from the inside of the powder supplying parts 50A and 50B; so that both are not mixed.

Figure 4A:
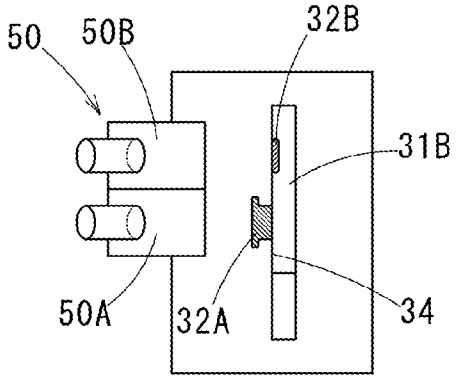
FIGS. 4A and 4B are drawings following a state shown in FIGS. 3A and 3B, schematically showing the upper surface of the die in FIG. 4A showing a state in which the shoe box is moved aside from an upper surface of the cavity; and a vertical sectional view thereof in FIG. 4B.
Figure 4B:
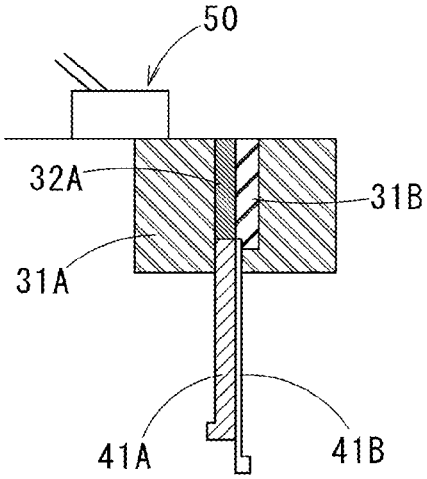
Figure 5A:
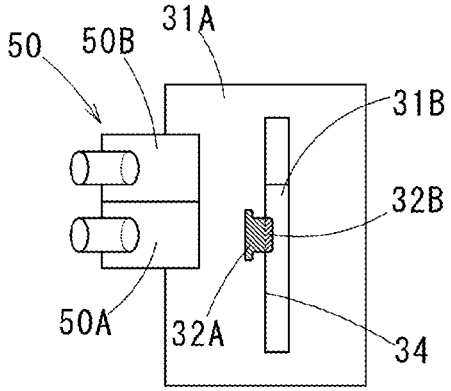
FIGS. 5A and 5B are drawings following a state shown in FIGS. 4A and 4B, schematically showing the upper surface of the die in FIG. 5A showing a state in which segmental dies are moved and combined, and a vertical sectional view thereof in FIG. 5B.
Figure 5B:
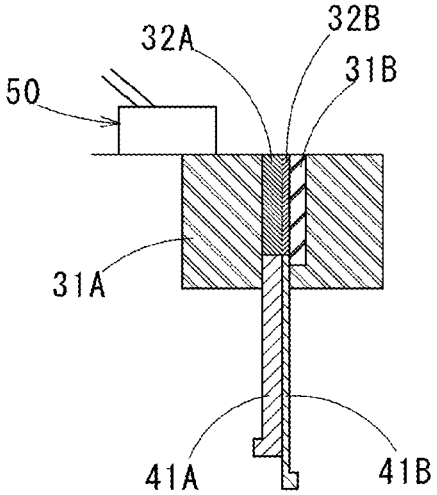

After moving the shoe box 50 aside from above the divided cavities 32A and 32B as shown in FIGS. 4A and 4B, and then moving the second segmental die 31B to the initial position along the division plane 34, so that both the divided cavities 32A and 32B divided by the two dies 31A and 31B are combined together as shown in FIGS. 5A and 5B.

Figure 6A:
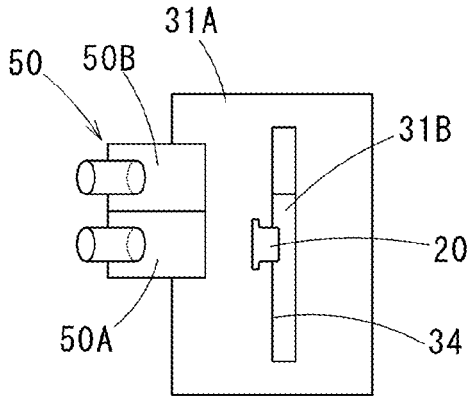
FIGS. 6A and 6B are drawings following a state shown in FIGS. 5A and 5B, schematically showing the upper surface of the die in FIG. 6A showing a state of compressing the powder, and a vertical sectional view thereof in FIG. 6B.
Figure 6B:
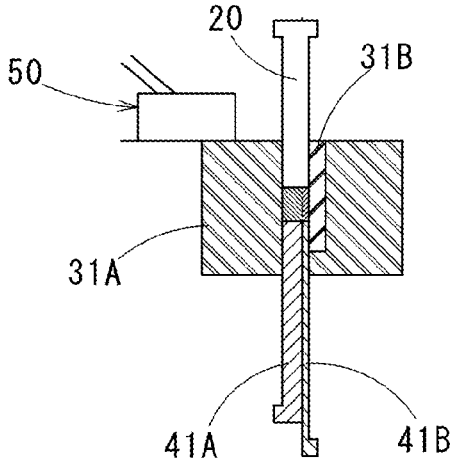

And as shown in FIGS. 6A and 6B, moving the upper punch 20 down, the raw material powder in the cavity 32 is compressed with the lower punch 41.

After that, after discharging the compressed body from the cavity 32 by moving the die 31 down as shown in FIGS. 1A and 1B, then, it is finished to the final multilayer molded article 1 by performing the sintering step, and as necessary the reforming step and the like.

As described above, the multilayer molded article 1 is manufactured from the compressed powder body which is formed by separating the cavity 32 into two, feeding the raw material powder there respectively, and combining them in the compressed powder body forming step. In that compressed powder body forming step, the shoe box 50 moves to the direction orthogonal to the division plane 34, and it is possible to supply the raw material powder to the respective divided cavities 32A and 32B from both the powder supplying parts 50A and 50B separated by the partition wall 53 without mixing them. Moreover, it is different from the division punch described in the above mentioned Japanese Unexamined Publication No. H08-318010: since the divided cavities 32A and 32B are separated and combined by sliding the second segmental die 31B along the division plane 34, the raw material powder is not crumbled in both the divided cavities 32A and 32B at a boundary surface. Accordingly, the obtained compressed powder body (the multilayer molded article 1) is formed with high accuracy at the boundary surface of the layers and also it is reliably prevented to mix the raw material powder.

Figure 12A:
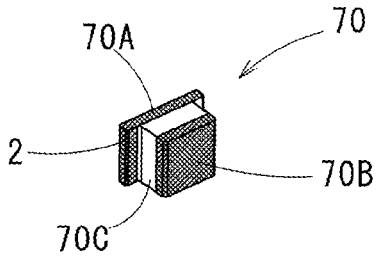
FIGS. 12A-12C show a second embodiment of the present invention.
Figure 12B:
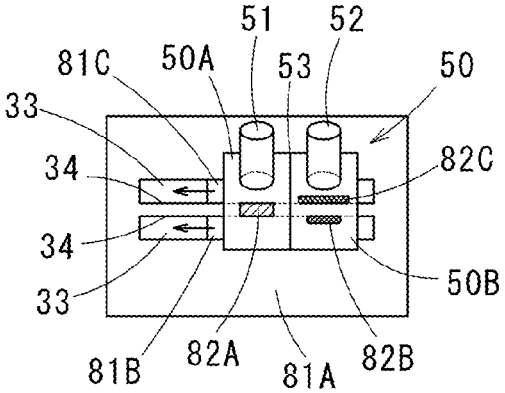
Figure 12C:
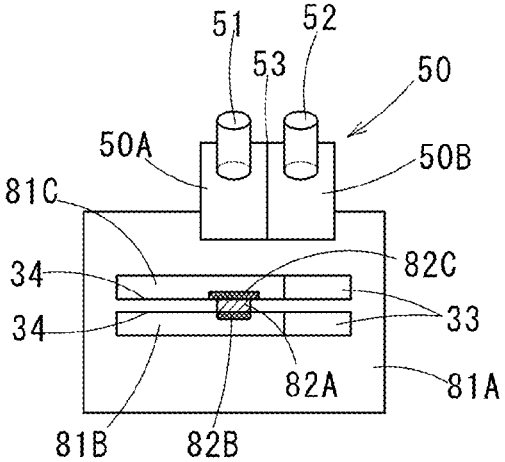

FIGS. 12A-12C show a second embodiment of the present invention. As shown in FIG. 12A, in a multilayer molded article 70 of the present embodiment, an one-side part side block 70A having the project part 2 and an other-side part side block 70B on a counter side are formed from a same kind of raw material powder, and a center side block 70C between them is formed from a different kind of raw material powder. An external form is a same as that of the multilayer molded article 1 of the first embodiment of FIG. 11. In addition, same parts as in the first embodiment are denoted by the same reference symbols and explanation thereof is simplified, and different parts will be mainly explained (it is the same in a next third embodiment).

In the manufacturing device, in a die 81, a pair of the grooves 33 with a rectangle shape in a plan view are formed parallel to each other on a first segmental die 81A which is in a fixed state: a second segmental die 81B and a third segmental die 81C are put in the respective grooves 33, as shown in FIGS. 12B and 12C. A first divided cavity 82A is formed between both the grooves 33 of the first segmental die 81A: formed are a second divided cavity 82B on the second segmental die 81B in one of the grooves 33, and a third divided cavity 82C on the third segmental die 81C in the third segmental die 81C so as to sandwich the first divided cavity 82A. The division planes 34 are side surfaces of the grooves 33 at which both ends of the first divided cavity 82A are in contact. Along the division planes 34, the second segmental die 81B and the third segmental die 81C are slid in the grooves 33 in a same direction shown by arrows in FIG. 12B.

Accordingly, the second segmental die 81B and the third segmental die 81C are moved together: in a position of being separated from the center first divided cavity 82A, the second divided cavity 82B of the second segmental die 81B and the third divided cavity 82C of the third segmental die 81C are arranged so as to be aligned along the divisional planes 34 with respect to the first divided cavity 82A; and the second divided cavity 82B and the third divided cavity 82C are arranged so as to be aligned along a direction orthogonal to the division planes 34. The shoe box 50 goes and returns in a direction orthogonal to the division planes 34 of the die 81, and is divided to the two powder supplying parts 50A and 50B by the partition wall 53 formed along the direction orthogonal to the division planes 34.

As shown in FIG. 12B, separating the second divided cavity 82B and the third divided cavity 82C from the first divided cavity 82A, then supplying the raw material powder individually into the first divided cavity 82A, and the second divided cavity 82B and the third divided cavity 82C from the shoe box 50; and as shown in FIG. 12C, moving the second segmental die 81B and the third segmental die 81C to the initial position so as to combine the divided cavities 82A to 82C, then compress-forming the raw material powder: so that it is possible to form the compressed powder body 70 (denoted by the same reference number as that of the multilayer molded article) in which the center side block 70C is formed from the different kind of raw material powder from that of the one-side part side block 70A and the other-side part side block 70B by the three divided cavities 82A to 82C.

Figure 13A:
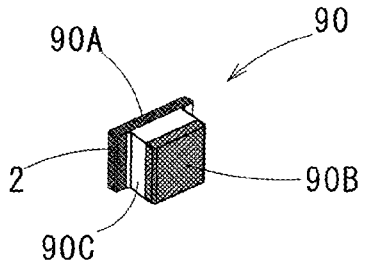
FIGS. 13A-13C are drawings showing a third embodiment of the present invention as same as in FIGS. 12A-12C.
Figure 13B:
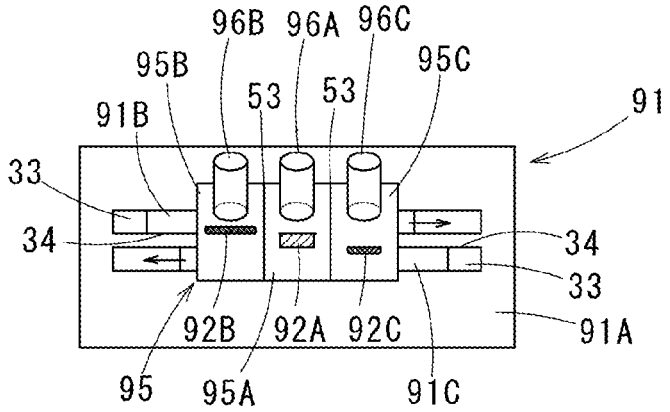
Figure 13C:
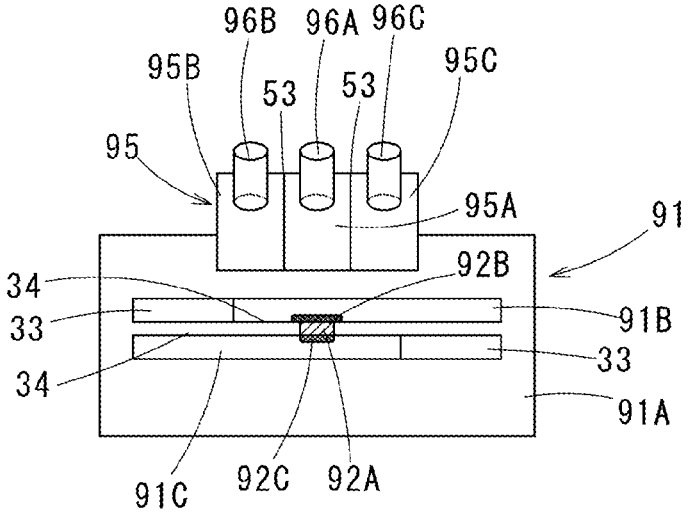

FIGS. 13A-13C show a third embodiment of the present invention. In a multilayer molded article 90 of this embodiment, formed are one-side part side block 90A having a projection part 2, an other-side part side block 90B on a counter side, and a center side block 90C from different kinds of raw material powder respectively as shown in FIG. 13C. An external form is the same as that of the multilayer molded article 1 of the first embodiment of FIG. 11.

In this manufacturing device, in a die 91, as shown in FIGS. 13B and 13C, a pair of grooves 33 with a rectangle shape in a plan view are formed parallel to each other on a first segmental die 91A which is in a fixed state; a second segmental die 91B and a third segmental die 91C are put in the respective grooves 33. A first divided cavity 92A is formed between the grooves 33 of the first segmental die 91A: formed are a second divided cavity 92B on the second segmental die 91B in one of the grooves 33, and a third divided cavity 92C on the third segmental die 91C so as to sandwich the first divided cavity 92A. Division planes 34 are side surfaces of the grooves 33 at which both ends of the first divided cavity 92A are in contact. Along the division planes 34, the second segmental die 91B and the third segmental die 91C are slid in the grooves 33 in different directions shown by arrows in FIG. 13B.

Accordingly, in this manufacturing device, the second divided cavity 92B and the third divided cavity 92C are separated to be left and right with respect to the center first divided cavity 92A along the division surfaces 34, so that the divided cavities 92A to 92C are arranged in three rows.

Also in a shoe box 95, powder supplying parts 95A to 95C are arranged in three rows so as to be aligned along the division planes 34 by being divided by two parallel partition walls 53 provided along a direction orthogonal to the division planes 34 of the die 91, and the shoe box 95 moving forward and backward along the direction orthogonal to the partition planes 34 of the die 91, so that the respective powder supplying parts 95A to 95C supply the raw material powder to the corresponding divided cavities 92A to 92C.

As described above, filling the different raw material powder in the three divided cavities 92A to 92C, the multilayer molded article 90 with three layers can be manufactured, so that it is possible to improve an accuracy of boundary planes and to reliably prevent the raw material powders from mixing.

In the method and device for manufacturing the multilayer molded article explained above, it can be utilized for a case of manufacturing a sliding part and a backup part thereof with variation of a mixture rate of copper in iron-copper sliding member, or a case of manufacturing a hard member with partially variation of a mixture rate of Co, or the like, for example.

The present invention is not limited to the above-described embodiments and various modifications may be made without departing from the scope of the present invention.

For example, the division planes of the dies are formed to be flat in the above embodiments: it is capable to form to be a curved surface curving in a sliding direction and the segmental dies can be moved along the curved surface in a case in which a multilayer molded article of a segment block shape is manufactured.

The shoe box is moved in a direction orthogonal to the division planes though: the shoe box can be moved in a direction diagonally crossing to the division planes if the raw material powder can be supplied to the respective divided cavities.

The different kinds of raw material powder are supplied to the respective divided cavities at one time though: it is applicable that shoe boxes are respectively provided for each kind of the raw material powder so that the raw material powder is supplied to the divided cavities individually.

Furthermore, after filling the raw material powder into the divided cavities, the raw material powder is compressed by the upper punch in a state in which the divided cavities are combined: it is possible that the upper punch is also segmented as in the lower punch and configured to be movable with the lower punch; then the raw material powder is filled into the respective divided cavities; and the raw material powder is temporarily compressed by inserting the segmented upper punches into the divided cavities in the divided state: and it is applicable that the divided cavities and the upper punch are combined after the temporary compressing and the compressed powder body is formed.

INDUSTRIAL APPLICABILITY

In an iron-copper sliding member, it is applicable for various multilayer molded articles formed from multilayers consist of different kinds of raw material powder, for example, in a case in which it is manufactured with different mixing rates of copper between a sliding part and a backup part.

REFERENCE SIGNS LIST

1, 70, 90 multilayer molded article
10 manufacturing device
20 upper punch
30 lower die
31 die
31A first segmental die
31B second segmental die
32 cavity
32A first divided cavity
32B second divided cavity
34 division plane
36 stopper
50 shoe box
50A, 50B powder supplying part
53 partition wall
81 die
81A first segmental die
81B second segmental die
81C third segmental die
82 cavity
82A first divided cavity
82B second divided cavity
82C third divided cavity
91 die
91A first segmental die
91B second segmental die
91C third segmental die
92A first divided cavity
92B second divided cavity
92C third divided cavity
95 shoe box
95A to 95C powder supplying part

The invention claimed is:

1. A manufacturing device of a multilayer molded article comprising:

a die forming a cavity;

a lower punch which is configured to be vertically inserted into the cavity from beneath and an upper punch which is configured to be inserted into the cavity from above; and a shoe box which is configured to move on a surface of the die in order to fill raw material powder into the cavity, wherein the die and the lower punch are segmented into a plurality of segmental dies and segmental lower punches by a division plane formed parallel to a direction of a vertical insertion of the lower punch across the cavity, and slidable along the division plane;

the segmental dies and the segmental lower punches are configured such that the cavity can be divided into a plurality of divided cavities along the division plane when one of the segmental dies and one of the segmental lower punches integrally slide horizontally on the division plane in a state where the one of the segmental lower punches is inserted into the one of the segmental dies; and the shoe box is configured to move along a direction crossing the division plane and to supply the raw material powder into the divided cavities.

2. The manufacturing device of a multilayer molded article according to claim 1, wherein in the shoe box, a plurality of powder supplying parts storing the raw material powder are provided so as to be arranged along the division plane.

3. The manufacturing device of a multilayer molded article according to claim 1, wherein the division plane is a flat surface.

4. The manufacturing device of a multilayer molded article according to claim 1, wherein the division plane is a curved surface curving in a sliding direction.

5. The manufacturing device of a multilayer molded article according to claim 2, wherein the division plane is a flat surface.

6. The manufacturing device of a multilayer molded article according to claim 2, wherein the division plane is a curved surface curving in a sliding direction.

7. A method of manufacturing a multilayer molded article, the said method comprising the steps of:

segmenting a die for forming a cavity and a lower punch adapted to be inserted into the cavity into a plurality of segmental dies and a plurality of segmental lower punches;

sliding one of the segmental dies and one of the segmental lower punches along a vertical division plane across the cavity so that a plurality of divided cavities which are divided along with the sliding of the one of the segmental dies and the one of the segmental lower punches are aligned along the division plane, which is formed horizontally and parallel to an insertion direction;

filling raw material powder into the respective divided cavities; and sliding the one of the segmental dies and the one of the segmental lower punches horizontally and integrally along the division plane so that the segmental dies and the segmental lower punches are combined to form the original die and lower punch, so as to combine the divided cavities with each other as the original cavity and to compress the raw material powder in the combined cavity between an upper punch and the lower punch, wherein the one of the segmental dies and the one of the segmental lower punches slide horizontally and integrally along the division plane in a state where the one of the segmental lower punches are inserted into the one of the segmental dies.

* * * * *